US006508034B1

(12) United States Patent
Nilsen

(10) Patent No.: US 6,508,034 B1
(45) Date of Patent: Jan. 21, 2003

(54) REPLACEABLE SEAL FOR WATERTIGHT AND FIRE-RESISTANT SLIDING DOORS

(75) Inventor: Rolf Gunnar Nilsen, Akland (NO)

(73) Assignee: IMS A/S, Akland (NO)

( * ) Notice: Subject to any disclaimer, the term of this patent is extended or adjusted under 35 U.S.C. 154(b) by 0 days.

(21) Appl. No.: 09/868,787

(22) PCT Filed: Dec. 21, 1999

(86) PCT No.: PCT/NO99/00398

§ 371 (c)(1),
(2), (4) Date: Jun. 21, 2001

(87) PCT Pub. No.: WO00/37763

PCT Pub. Date: Jun. 29, 2000

(30) Foreign Application Priority Data

Dec. 21, 1998 (NO) ..... 19986020

(51) Int. Cl.[7] ..... E06B 3/46; E63B 42/26
(52) U.S. Cl. ..... 49/484.1; 49/482.1
(58) Field of Search ..... 49/482.1, 483.1, 49/484.1, 475.1; 277/399, 630, 637, 644

(56) References Cited

U.S. PATENT DOCUMENTS 2,443,751 A * 6/1948 Terepin et al. ..... 244/121
4,356,856 A * 11/1982 Bengtsson ..... 160/209
5,141,361 A * 8/1992 Fontaine ..... 406/106
5,528,863 A * 6/1996 Scott ..... 49/480.1
6,193,600 B1 * 2/2001 Ito et al. ..... 454/69

FOREIGN PATENT DOCUMENTS

NO 79458 11/1951
NO 151477 1/1985

* cited by examiner

*Primary Examiner*—Gregory J. Strimbu
(74) *Attorney, Agent, or Firm*—Browdy and Neimark, P.L.L.C.

(57) ABSTRACT

A replaceable seal for water-tight and fire-resistant sliding doors, in particular for use on board ships and rigs, is roughly trapezoidal in shape having two opposite short sides, a long side therebetween, and a side of intermediate length opposite the long side. The intermediate length side of the seal is intended to lie against one of the arms of a Y-shaped support; one of the short sides of the seal is intended to lie against the upright of the Y-shaped support; the long side of the seat is intended to lie against a fastening device, preferably of a washer held with a bolt and nut; and the second short side forms the sealing surface of the seal for sealing against a door frame.

5 Claims, 1 Drawing Sheet

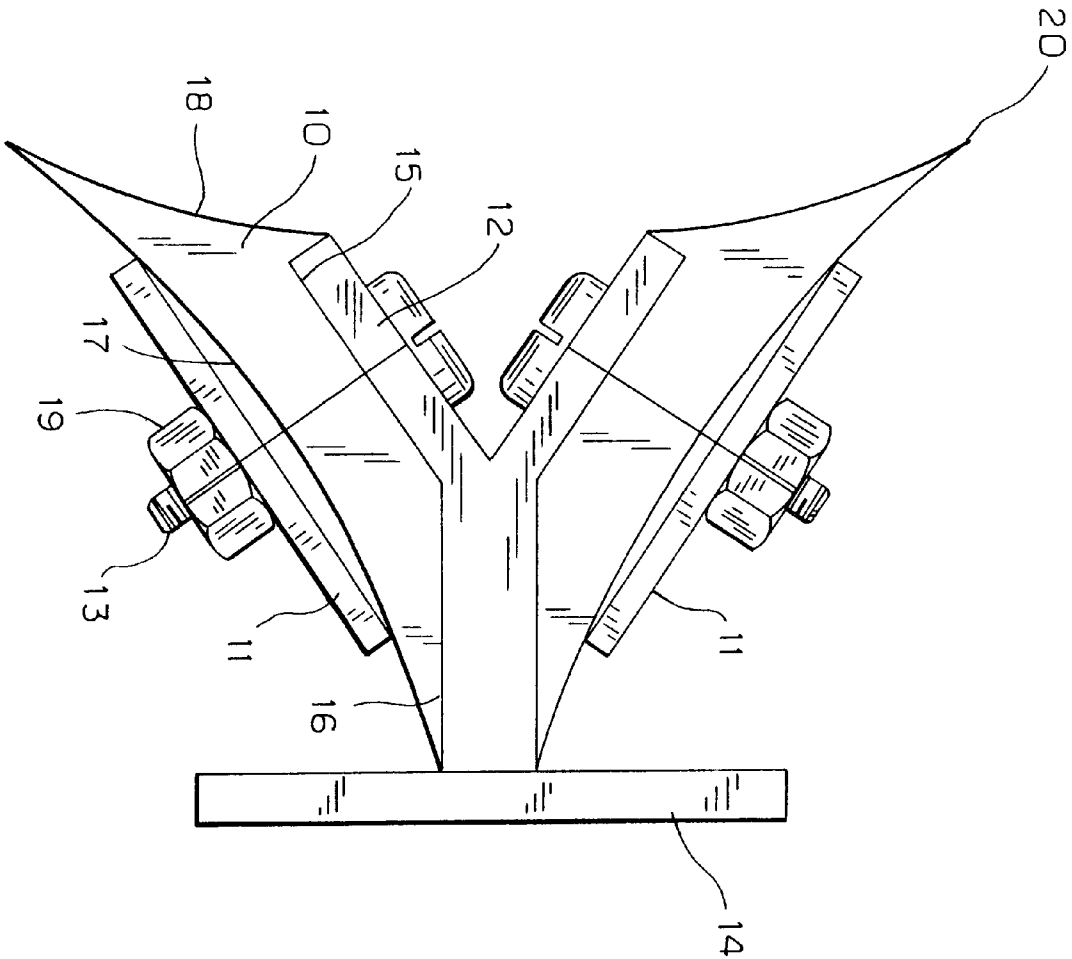
20
10
18
15
12
17
19
13
11
16
11
14

REPLACEABLE SEAL FOR WATERTIGHT AND FIRE-RESISTANT SLIDING DOORS

REFERENCE TO RELATED APPLICATIONS

The present application is the national stage under 35 U.S.C. 371of international application PCT/NO99/00398, filed Dec. 21, 1999 which designated the United States, and which international application was published under PCT Article 21(2) in the English language.

BACKGROUND OF THE INVENTION

The present application relates to a replaceable seal for watertight and fire-resistant sliding doors. More specifically, the invention relates to replaceable seals for sliding doors used in particular on board ships and rigs, and to be absolutely specific, the invention relates to such replaceable seals in connection with doors capable of functioning both as A0 fire doors and as watertight sliding doors. NO 151 477-B describes watertight sliding doors where sealing strips are arranged between the peripheral portion of the door and the door frame.

The door and sealing strips described in this patent are intended for use on board ships and offshore platforms where there are a number of openings which it must be possible to close in a watertight manner, for example, hatches, ports and so on.

In order to ensure a satisfactory watertightness around the peripheral portion of the door, the sealing strips must be compressed once the door has been closed, and this is achieved according to the patent by a Y-section with accompanying lip seals.

Recently, it has become a requirement that watertight doors of the type described in NO 151 477-B must also be fire-resistant.

In addition, it has been found that there is a need to be able to change the seals in a simple, fast and inexpensive manner when damage occurs.

It is an objective of the present invention to solve the problems indicated above and to satisfy market requirements by means of a further development and improvement of the technology described in NO 151 477.

SUMMARY OF THE INVENTION

Thus, the present invention relates to replaceable seals mounted on the outside of a Y-shaped support provided on the periphery of a door leaf, for watertight and fire-resistant sliding doors, in particular for use on board ships and rigs, and these seals are characterized in that they are trapezoidal in shape, wherein the side of the intermediate length forms a surface of contact against one of the arms of the Y-shaped support;

the first short side forms a surface of contact against the upright of the Y;

the long side forms a surface of contact against fastening means, preferably washers held with nuts and bolts; and the second short side forms the sealing surface of the seal against a door frame.

According to a preferred embodiment of the inventive subject, the replaceable seals are made of a rubber-elastic, watertight and A0 fire-resistant material.

BRIEF DESCRIPTION OF THE DRAWINGS

FIG. 1 shows a preferred embodiment of the present invention.

DESCRIPTION OF THE INVENTION

A door leaf whose periphery is equipped with the inventive seal is indicated by means of the reference numeral 14.

A Y-shaped support 12 is welded in place along the periphery of the door leaf 14.

The arms of the Y arms are equipped with holes for fastening devices for the replaceable seals, as will be described below.

The inventive replaceable seal is indicated by means of the reference numeral 10.

Each replaceable seal is generally trapezoidal in shape and the faces have the following functions:

The shorter side 15 of the two parallel or substantially parallel relatively long faces is intended to lie against the outer side of the upright of the Y-shaped support 12.

The first short face 16 of the non-parallel faces of the trapezoid 2 is intended to lie against the respective side of the upright of the Y-shaped support.

The long side 17 of the two parallel or substantially parallel relatively long faces comes to lie, in the illustrated embodiment, against a washer 11, which, with the aid of a nut 19 on a threaded bolt 13, serves to secure the seal.

The last short face 18 of the non-parallel faces of the trapezoid is so constructed as to lie against the surface with which the watertightness or fire-resistance is to be obtained.

Each Y-shaped support supports two replaceable seals of a symmetrically identical type on each outer side of the Y-shaped support.

In the event of water pressure on one or the other side of the seal arrangement as shown in the figure, in principle parallel with the plane of the door leaf 14, the free part, indicated by means of the reference numeral 20 in the figure, will be pressed progressively harder against the surface against which it is sealed and on increasing pressure an ever-greater area of the face 18 will be pressed against the opposite surface and thus provide an increasingly stronger seal.

In cases of fire, a seal of the type outlined above will be charred on the exposed side, thereby forming insulation between the door leaf 14 and the opposite door frame, and where the protection is sufficiently good to satisfy fire class AO standards.

The inventive seal system permits variations not possible hitherto, for equipping, by use of a standard design, sliding doors with seals of different types according to the requirements which must be met, since the seals are standardised and replaceable and can be changed using simple mechanical aids and with the use of a retaining washer 11, bolts 13 and nuts 19.

In addition to the differences in quality in each individual category, the purpose of Y-shaped support 12 according to the invention is to support seals which are both watertight and A0 fire-resistant and which therefore in a simple manner combine essential features and meet requirements laid down in part in the existing regulations.

What is claimed is:

1. In combination, a seal apparatus and a door leaf, the seal apparatus comprising a replaceable seal (10) mounted on a Y-shaped support (12) having an upright and two arms, said Y-shaped support being provided on a periphery of the door leaf;

wherein the seal (10) is roughly trapezoidal in shape having two opposite short sides (16 and 18), a long side (17) therebetween and a side (15) of intermediate length opposite said long side, wherein:

the side (15) of intermediate length includes a surface of contact against one of the arms of the Y-shaped support (12);

a first of said short sides (16) includes a surface of contact against the upright of the Y-shaped support (12);

the long side (17) includes a surface of contact against a fastening device; and a second of said short sides (18) includes a sealing surface of the (10).

2. The combination of claim 1, characterized in that the seal (10) is made of a rubber-elastic, fire -resistant material.

3. The combination of claim 2 wherein said material satisfies international standard fire class A0.

4. The combination of claim 1 wherein said fastening device comprises a washer (11) with a bolt (13) and a nut(19).

5. A sealing device for watertight sealing of a closure in an opening, comprising a Y-shaped support (12) adapted for mounting on a periphery of the closure, said Y-shaped support (12) having an upright and two arms; and a pair elastomeric seals (10), a first of said elastomeric seals being mounted on one of said arms of said Y-shaped support (12), and a second of said elastomeric seals being mounted on a second of said arms of said Y-shaped support (12), each of said elastomeric seals being roughly trapezoidal in shape, having two opposite short sides, a long side therebetween, and a side of intermediate length opposite said long side, the side (15) of intermediate length of each of said seals lying against a respective one of said arms of said Y-shaped support (12), a first of said short sides (16) of each of said seals lying against the upright of said Y-shaped support (12), said long side (17) of each of said elastomeric seals comprising a respective surface of contact against a respective fastening device, and a second of said short sides (18) of each of said seals being adapted to seal against a periphery defining the opening.

* * * * *